US007114275B1

(12) United States Patent
Sordahl

(10) Patent No.: US 7,114,275 B1
(45) Date of Patent: Oct. 3, 2006

(54) SYSTEM FOR CREATING AND DISPLAYING AN ADVERTISING MESSAGE ON AN AUTOMOBILE RADIO ANTENNA

(76) Inventor: Eileen Sordahl, 917 S. Capitola Way, Boise, ID (US) 83702

( * ) Notice: Subject to any disclaimer, the term of this patent is extended or adjusted under 35 U.S.C. 154(b) by 0 days.

(21) Appl. No.: 10/908,094

(22) Filed: Apr. 27, 2005

(51) Int. Cl.
*G09F 21/04* (2006.01)

(52) U.S. Cl. ..... 40/591; 116/28 R

(58) Field of Classification Search ..... 40/591, 40/592; 116/28 R, 209
See application file for complete search history.

(56) References Cited

U.S. PATENT DOCUMENTS 2,856,891 A * 10/1958 Solomon ..... 116/173
5,078,075 A * 1/1992 Liming et al. ..... 116/173
5,740,622 A * 4/1998 Martin ..... 40/591
5,836,261 A * 11/1998 Sutton ..... 116/209
D425,069 S 5/2000 Suh
6,063,459 A 5/2000 Velte
D427,179 S 6/2000 Gamble, Jr.
6,197,390 B1 * 3/2001 LaVite ..... 428/31
D440,963 S 4/2001 Mueth
D456,016 S 4/2002 Denson

* cited by examiner

*Primary Examiner*—Cassandra Davis
(74) *Attorney, Agent, or Firm*—Robert A. Huntsman, PLLC; Robert A. Huntsman

(57) ABSTRACT

A system for creating and displaying an advertising message on an automobile radio antenna using a plurality of symbolic fixtures to form a vertical message. In the preferred embodiment, each symbolic fixture includes a clip placed in a crevice in a lateral surface of the fixture, so each fixture can be snapped out without sliding the fixture over the antenna. The clips optionally include a removal tab which may be either hidden or visible to assist in easy removal of the symbolic fixtures when changing the displayed message.

12 Claims, 4 Drawing Sheets

SYSTEM FOR CREATING AND DISPLAYING AN ADVERTISING MESSAGE ON AN AUTOMOBILE RADIO ANTENNA

BACKGROUND OF THE INVENTION

This invention relates generally to creating and displaying a consumer modifiable advertising message on an automobile radio antenna.

There are many known ornamental attachments designed for vehicle antennas. Traditional antenna attachments are formed by boring a hole through the center of the attachment. Such prior art antenna attaches are secured to the antenna by threading the antenna through the hole.

There are known problems with this method of attachment. U.S. Pat. No. 4,526,820 observes that such a method is problematic in that vehicle antenna generally have a tip with a larger diameter than the rod of the antenna, so the mounting hole is undesirably enlarged when sliding the attachment onto the antenna, making it difficult or impossible for the attachment to remain securely positioned on a particular place on the antenna. The '820 patent teaches an improvement wherein the channel contains recesses to accommodate the larger antenna tip. While the '820 is a significant improvement over the prior art, it suffers from at least three shortcomings. First, it relies on the center bore channel of the prior art for attachment which allows the attachment to be undesirably rotated when the vehicle is traveling at high speeds. Second, antenna tips are not standardized so unique attachment must be prepared for each different size an style of antenna tip. Third, the '820 is limited to attachments contemplated, prepared, and distributed by the manufacturer.

What is needed is an improved system that overcomes these limitations and provides the consumer with a flexible, easy, and reliable system to design and modify advertising messages create by the consumer for display on an automobile radio antenna.

SUMMARY OF THE INVENTION

The present invention solves these problems by departing from the prior art method of providing a unitary attachment having a center bored hole. The present invention consists of an arbitrary large set of symbolic fixtures. Each separate fixture has an embedded clip contained within a crevice in one surface of the attachment. Although the present invention contemplates a crevice containing a clip on any surface of the attachment, a crevice on either the back or front surfaces is disfavored since the presence of a crevice can detract from the artistic nature and readability of the symbol represented by the attachment. For this reason the preferred embodiment teaches a crevice containing the clip on a lateral surface—either the left or right surfaces of the symbolic attachments in the preferred embodiment. In the preferred embodiment, the fixtures are six side cubes, having a top, bottom, front, back, left and right surfaces. In an alternate embodiment, fixtures could be realized in other geometric shapes, in which case lateral surfaces would refer to and all surfaces excluding the top, bottom, front or back surface.

Unlike the prior art attachments, the symbolic fixtures of the present invention snap directly onto the antenna at the desired vertical position, eliminating the need of the prior art to slide the attachment over the antenna. Second, by providing a set of individual symbolic fixtures, the consumer can design and choose an advertising message of his choice. In one embodiment, the set of fixtures includes letters, numbers, and punctuation typical of that found on a typewriter or computer keyboard. With such a set, the consumer can choose and display a textual advertising message. It should be noted that advertising is used here in its broadest sense, the advertising messages are not limited to commercial messages; the advertising messages contemplated include, but are not limited to, personal messages, commercial messages, political messages, religious messages, and "vanity" messages such as those often included on customized license plates.

The present invention also includes an optional visible removal tab to enable symbolic fixtures to be removed quickly and easily. The removal tab can be located anywhere within the fixture; in the preferred embodiment, the removal tab is located at the top of the fixture. However, in some environments, the inclusion of such a tab can encourage theft of the symbolic fixtures. Thus an alternate embodiment contemplates a variation where the removal tab is hidden within the crevice to deter theft.

BRIEF DESCRIPTION OF THE SEVERAL DRAWINGS

Figure 4:
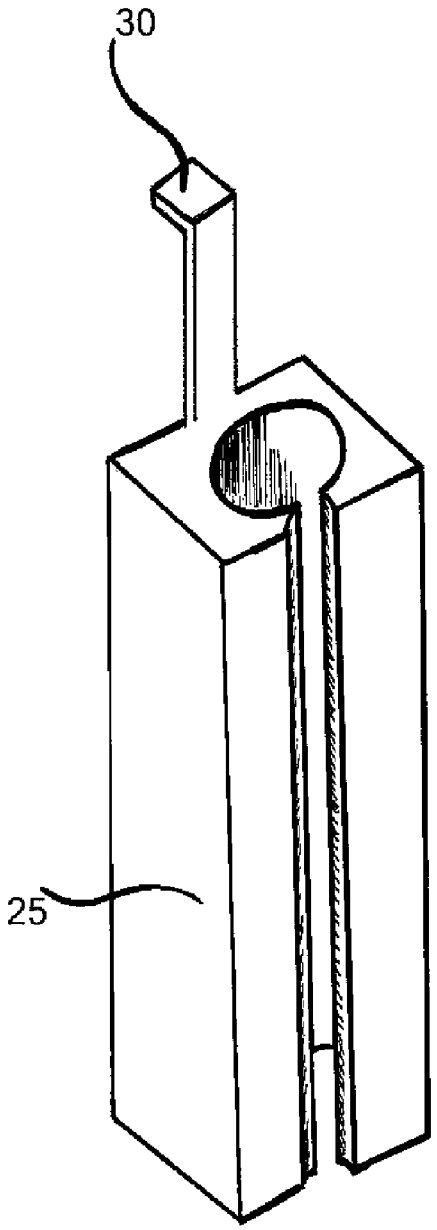

FIG. 4. is an enlargement of the clip showing the removal tab which may either be visible or hidden.

Figure 5:
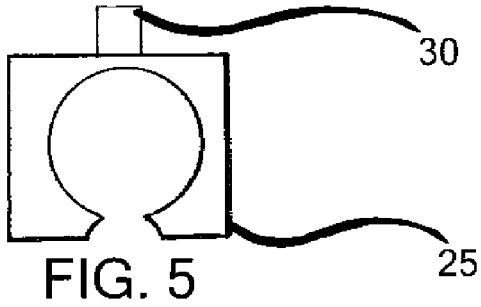

FIG. 5. is a top view of a clip having a removal tab.

Figure 6:
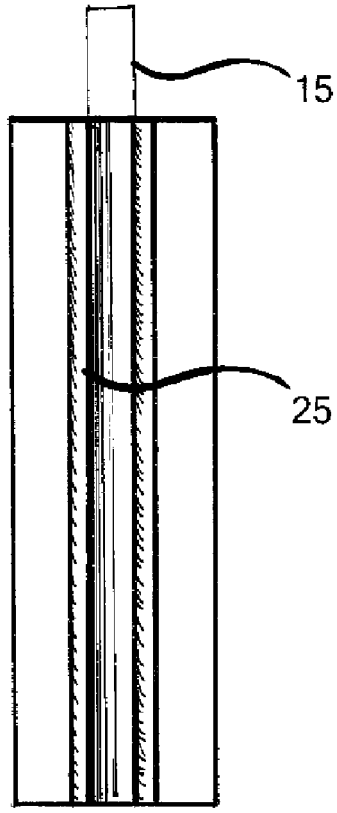

FIG. 6. is a view of the clip as it might appear when attached to an antenna.

Figure 7:
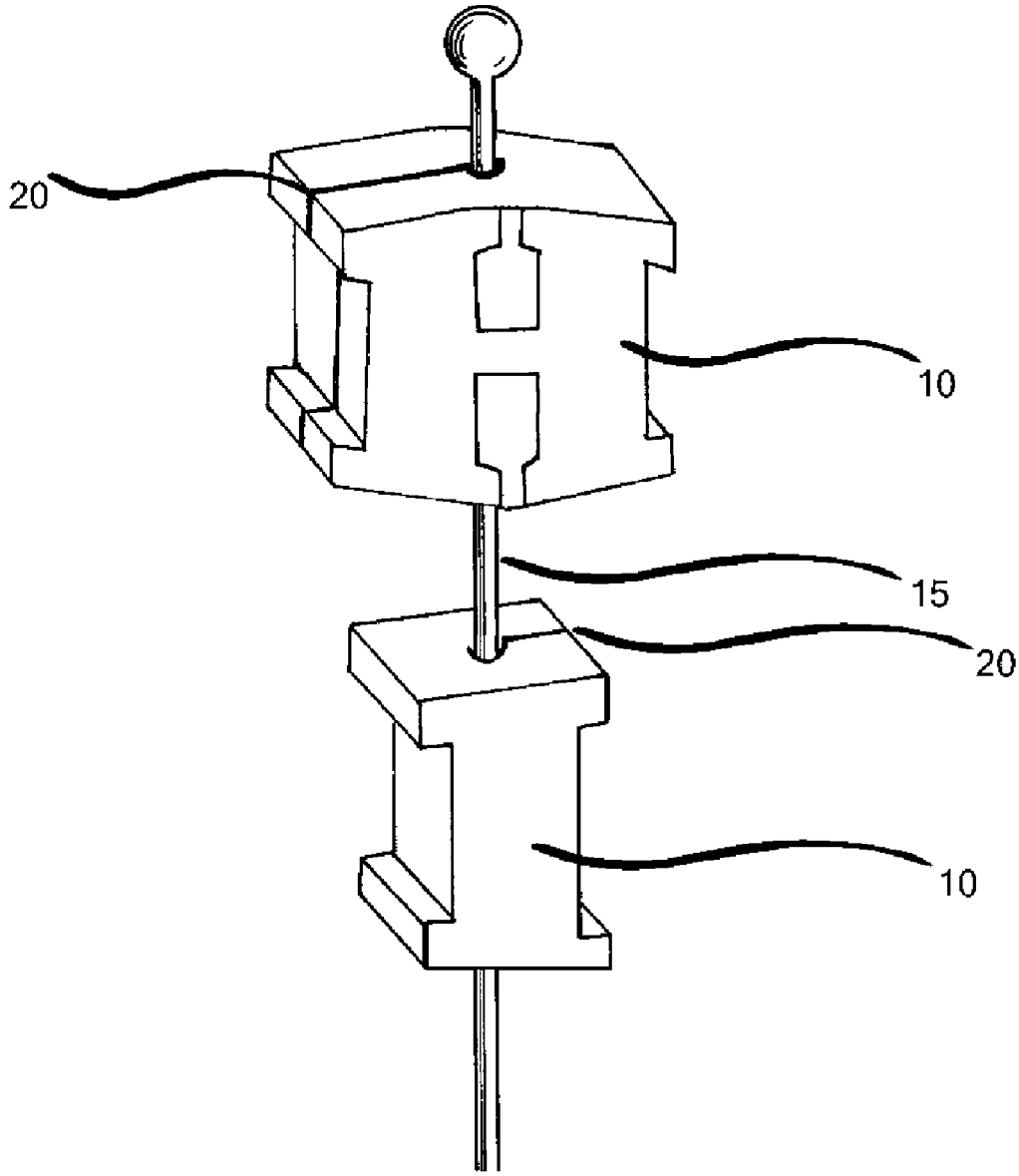

FIG. 7 illustrates a pair of symbolic fixtures vertical forming the message "HI", wherein the "H" is attached by a clip embedded in a crevice on the right lateral surface and the "i" is attached by a clip extruding from a crevice on the left lateral surface according to the preferred embodiment.

DETAILED DESCRIPTION OF THE INVENTION

The present invention generally allows a consumer to select and display an advertising message on rod-like radio antennas found on many makes of automobiles. Advertising message is defined generally to include both textual messages typical composed of alphabetic letters and punctuation, and artistic messages, composed of non textual symbols. The type of messages contemplated includes, but is not limited to, personal, commercial, seasonal, political, and religious messages.

Figure 1:
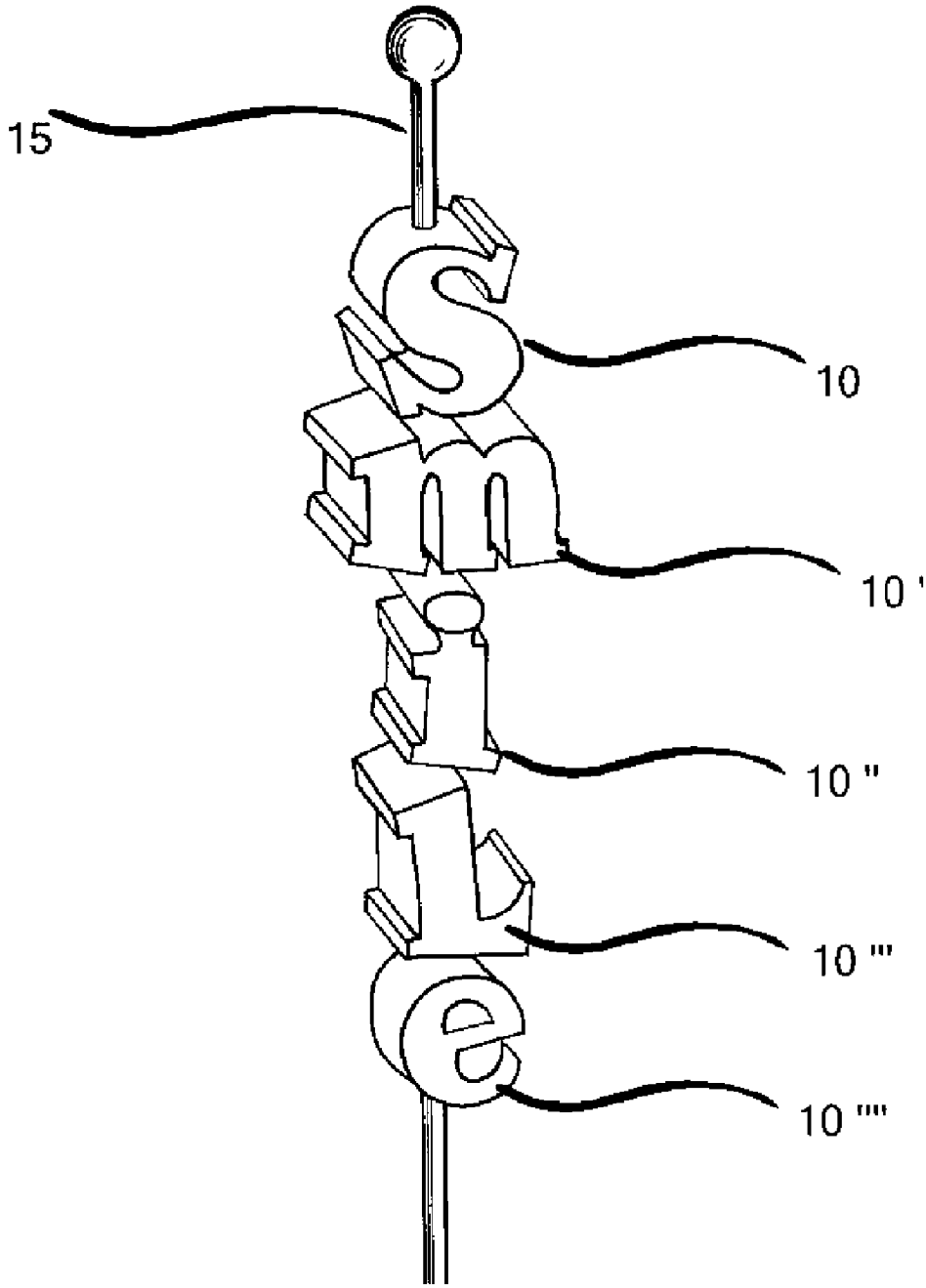
FIG. 1 illustrates one embodiment of the present invention wherein the symbolic fixtures include letters of the alphabet, vertically stacked on an automobile radio antenna presenting the word message "smile".

FIG. 1 shows the preferred embodiment of the invention as typically deployed on an automobile antenna. Referring to FIG. 1, five symbolic fixtures representing the letter "s" 10, "m" 10', "i" 10", "l" 10'", and "e" 10"", collectively spelling the word messages "smile" when read vertically. The fixtures are attached by a clip embedded in a crevice on the right side (not explicitly shown in FIG. 1).

Figure 2:
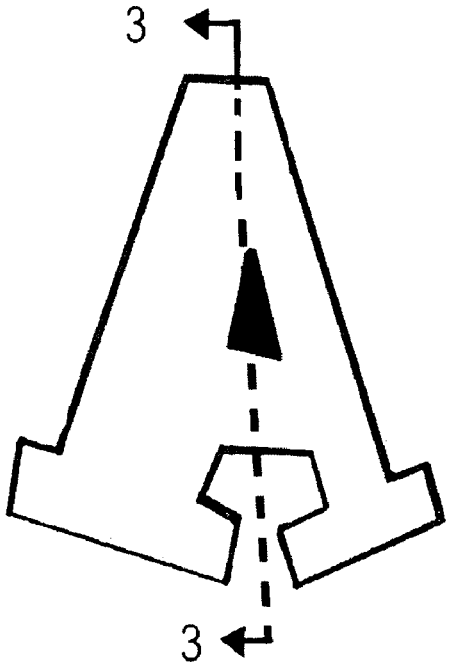
FIG. 2 illustrates cross section of the symbolic fixture representing the letter "A" where the crevice is on the right side of the fixture. The dotted line 3 of FIG. 2 identifies the cross sectional view illustrated in FIG. 3.
Figure 3:
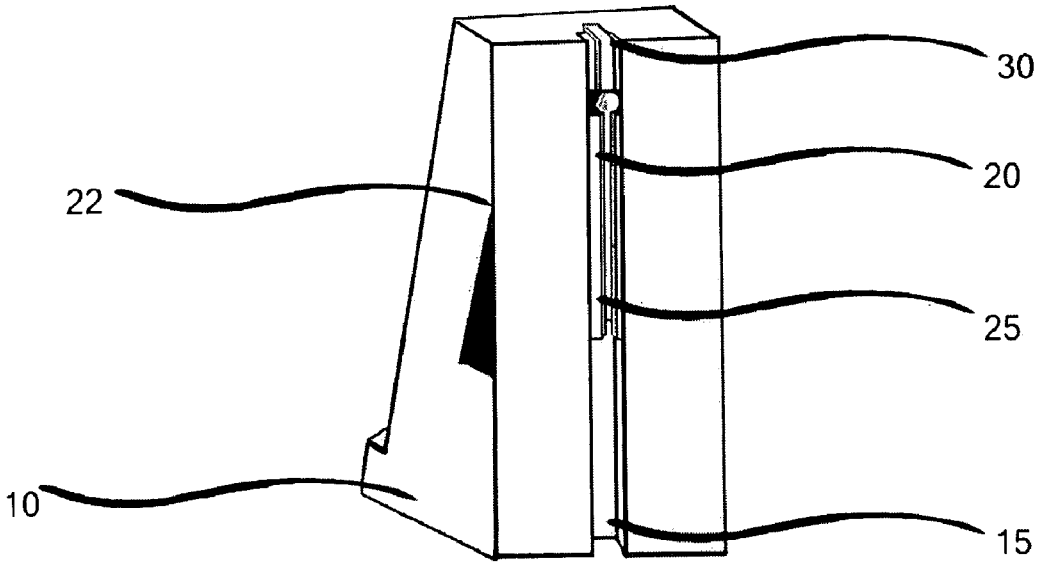
FIG. 3 is a cross section view of a symbolic attachment representing the letter "A" and shows a clip embedded in the fixture, the clip has a removal tab protruding above the top of the symbolic fixture, providing for easy removal of the symbolic fixture from an antenna.

FIG. 2 shows a single symbolic fixture 10 with a crevice 20 on the right side of the fixture 10. FIG. 3 is a right side view, showing a right side crevice having an embedded clip, the clip having a visible removal tab. Referring to FIG. 3, a clip 25 is embedded in the crevice 20 of the fixture 10. The clip 25 secures the fixture 10 onto the automobile radio antenna 15. The clip 25 has a removal tab 30 for easy removal that, in FIG. 3, protrudes above the fixture 10, and is thus visible.

FIGS. 4, 5 and 6 showing different views of a clip 25 having a removal tab 30. Referring to FIG. 4, FIG. 4 shows an enlarged view of a clip 25 having a removal tab 30. Referring to FIG. 5, FIG. 5 illustrates the top of a clip 25, also showing the removal tab 30. Referring to FIG. 6, FIG. 6 show a front view of a clip 25 securely attached to an antenna 15. Note that also this is a front view of the clip 25, in the preferred embodiment, the front view of the clip 25 would appear on the right of a symbolic fixture 10 (not shown if FIG. 6).

FIG. 7 shows an alternative embodiment, vertically spelling the word "Hi", with the "H" mounted using a clip inside a crevice, the crevice located on the left surface. The "i" is mounted using the preferred embodiment with the crevice that is on the right surface of the symbolic fixture.

The invention is typically deployed by a consumer to create a symbol or artistic message chosen by the consumer. To deploy the invention, the consumer typically acquires a set of symbolic fixtures 10. For a given message, typically only a subset of the fixtures available within the set are utilized. In the preferred embodiment, the set of symbolic fixtures includes all of the letters of the alphabet so that messages containing common words, phrase and names can be created and deployed. The invention contemplates a broad set of symbolic fixtures, including a variety of shapes, size and categories. Contemplated categories of symbolic fixtures includes, but is not limited to, hearts, flowers, starts, celestial bodies such as the sun, moon, planets, and stars, angels, mammals, amphibians, insects, sunglasses, shoes, plants, trees, hats, flags of various states and nations, all characters found on a typical keyboard, Christmas and other seasonal objects, and sports related symbols.

The preferred embodiment also included a removal tab to facilitate easy removal of a symbolic fixture when changing the message. One embodiment contemplates a removal tab that extrudes from the symbolic fixture, typically at the top. In some environments, a visible removal tab is undesirable because it facilitates theft, so the preferred embodiment teaches hiding the removal tab within the crevice holding the clip so that a person familiar wit the invention can easily remove symbolic fixtures, but a thief unfamiliar with the invention would be deterred from theft, particularly when a very strong clip is used to secure the symbolic fixture to the antenna.

The advertising messages formed using the present invention make be textual messages such as the "smile" of FIG. 1. The messages may also be artistic rather than textual where the symbolic attachments represent non-textual items such as hearts and flowers. The messages may be seasonal such as "Happy New Year" or religious, such as "Jesus Saves".

The description of the invention above includes several embodiments of the invention, but as one skilled in the art will appreciate, there are other uses and applications not explicitly illustrated in the description above that nevertheless are consistent with the spirit of the disclosed invention. The description above is provided by way of illustration and not limitation, and the invention, accordingly, should only be limited by the claims as set forth below.

What is claimed is:

1. A system for displaying an advertising message on an automobile radio antenna comprising:

a plurality of symbolic fixtures, each symbolic fixture further including:

a top, a bottom and a plurality of surfaces, a clip wherein the clip is capable of securely fastening the fixture to the antenna, each fixture forming a crevice on a surface of the fixture, the crevice extending from the top to the bottom of the fixture, wherein the crevice contains the clip, wherein the clip further includes a removal tab, wherein the symbolic fixtures are attached to the antenna to formulate an advertising message.

2. The system of claim 1 wherein each fixture includes a lateral surface wherein the crevice is formed on the lateral surface.

3. The system of claim 2 wherein the removal tab is hidden within the crevice.

4. The system of claim 2 wherein the removal tab visibly extrudes beyond the fixture.

5. The system of claim 1 wherein the removal tab is hidden within the crevice.

6. The system of claim 1 wherein the removal tab visibly extrudes beyond the fixture.

7. A symbolic fixture for an automobile radio antenna comprising:

a top, a bottom and a plurality of surfaces, a clip, wherein the clip further includes a removal tab, wherein the clip is capable of securely fastening the fixture to the antenna, the fixture forming a crevice on a surface of the fixture, the crevice extending from the top to the bottom of the fixture, wherein the crevice contains the clip.

8. The system of claim 7 wherein the fixture includes a lateral surface wherein the crevice is formed on the lateral surface.

9. The system of claim 8 wherein the removal tab is hidden within the crevice.

10. The system of claim 8 wherein the removal tab visibly extrudes beyond the fixture.

11. The system of claim 7 wherein the removal tab is hidden within the crevice.

12. The system of claim 7 wherein the removal tab visibly extrudes beyond the fixture.

* * * * *